US007810752B2

(12) United States Patent
Tippett

(10) Patent No.: US 7,810,752 B2
(45) Date of Patent: Oct. 12, 2010

(54) COMPACT COLLAPSIBLE WIRE REEL

(75) Inventor: Todd A. Tippett, Glendale, AZ (US)

(73) Assignee: Textron Innovations Inc., Providence, RI (US)

( * ) Notice: Subject to any disclaimer, the term of this patent is extended or adjusted under 35 U.S.C. 154(b) by 76 days.

(21) Appl. No.: 11/196,910

(22) Filed: Aug. 4, 2005

(65) Prior Publication Data

US 2006/0157611 A1 Jul. 20, 2006

Related U.S. Application Data

(60) Provisional application No. 60/645,909, filed on Jan. 20, 2005.

(51) Int. Cl.
*B65H 75/22* (2006.01)

(52) U.S. Cl. ..... 242/401; 242/129

(58) Field of Classification Search ..... 242/401, 242/404, 404.1, 404.2, 404.3, 407.1, 607.1, 242/128, 129, 130.2, 388.6, 388.9, 398, 577.3, 242/588, 588.6, 127; 248/324, 323, 317.58, 248/59

See application file for complete search history.

(56) References Cited

U.S. PATENT DOCUMENTS 1,592,161 A * 7/1926 Schultz ..... 118/52
3,017,136 A * 1/1962 Noffke ..... 242/129
D344,229 S * 2/1994 Nelson ..... D8/358
5,348,241 A 9/1994 Huette
6,367,725 B1 4/2002 Goodwin
2005/0116083 A1* 6/2005 Bayer et al. ..... 242/597.7

OTHER PUBLICATIONS

Various web pages accessed by the domain name TOOLFETCH.COM on Jun. 22, 2005. Publication date unknown.

Various web pages accessed by the domain name TOOLUP.COM on Jun. 22, 2005. Publication date unknown.

Various web pages accessed by the domain name SJGREATDEALS.COM on Jun. 22, 2005. Publication date unknown.

Various web pages accessed by the domain name LANER.COM on Jun. 22, 2005. Publication date unknown.

Various web pages accessed by the domain name RACK-A-TIERS.COM on Jun. 23, 2005. Publication date unknown.

* cited by examiner

*Primary Examiner*—John Q Nguyen
*Assistant Examiner*—William E Dondero
(74) *Attorney, Agent, or Firm*—Clark Hill PLC

(57) ABSTRACT

A collapsible wire reel is disclosed. The device comprises a stationary arm that can connect the device to a building's rafters during use and two supporting arms that support a spool. The stationary and supporting arms are collapsible and enable the device to be easily folded for storage and transport.

18 Claims, 5 Drawing Sheets

COMPACT COLLAPSIBLE WIRE REEL

CROSS-REFERENCE TO RELATED APPLICATIONS

This application claims the benefit of co-pending provisional application No. 60/645,909 filed on Jan. 20, 2005.

FIELD OF INVENTION

The present invention relates to a wire reel that can be suspended from a building's ceiling to dispense wire during construction. This invention particularly relates to a wire reel that comprises two supporting arms that are secured to a base that are capable of rotating about an axis at the base to fold from an extended position during use into a collapsed position for storage.

BACKGROUND

"Cabling" a building under construction refers to a process whereby a worker installs electrical wiring or other cables (collectively "wire"). Wire that is used in this process is typically sold in a spool or coil (collectively "spool") and must be pulled out from the spool and placed throughout various walls, floors, and ceilings so that it can connect a central electrical box to various outlets and switches. If the spool is not retained in one location where the wire can be pulled outward from the spool, the spool will roll about the floor and strike various walls and other objects which will cause the wire to become tangled. This creates a safety hazard and slows the cabling process down considerably.

Several different types of devices known as "wire reels" have been developed which keep the spool in one location while enabling wire to be pulled from it and placed throughout a building. These wire reels are either placed directly on the floor or hung from the building's rafters and come in a multitude of designs. Some wire reels include a large, flat circular base that supports the spool while others include a central base with several extended arms that support the spool. Because all known wire reels use either a flat, circular base or three or more arms to support the spool, it is more difficult to pull the wire from the spool than it would be if the wire reels used only two arms.

Additionally, all known wire reels are bulky and difficult to store and transport from one location to another. Very few known wire reels are collapsible for storage and transport, and the ones that are contain several moving parts which increase the chance of these devices being broken.

Therefore, it is an object of the present invention to provide a wire reel that is collapsible and easy to transport. Another object of the present invention is to provide a wire reel with two arms that can easily support and dispense wire from a spool. It is a further object of the present invention to provide a wire reel that is constructed of relatively few moving parts and is easily adjusted from an extended position to distribute wire and a collapsed position for storage and transport.

SUMMARY OF THE INVENTION

The present invention is a collapsible wire reel that is operable between an extended position to hold and support a spool of wire and a collapsed position for storage and transport. The wire reel comprises a base, a stationary arm that is used to suspend the spool from a support structure during use and enable the wire reel's rotation about an axis, and two supporting arms connected to the base that are operable between an extended position and a collapsed position. In the extended position, the supporting arms support the spool and allow it to spin about an axis as wire is pulled off the spool. In the collapsed position, the supporting arms are directly next to and parallel to the stationary arm which enables the wire reel to be easily transported and stored. In the preferred embodiment, only two supporting arms are used and they are angled downward at an angle greater than 90 degrees relative to the stationary arm which enables the wire to be easily pulled from the spool during cabling.

DETAILED DESCRIPTION OF THE INVENTION

Figure 1:
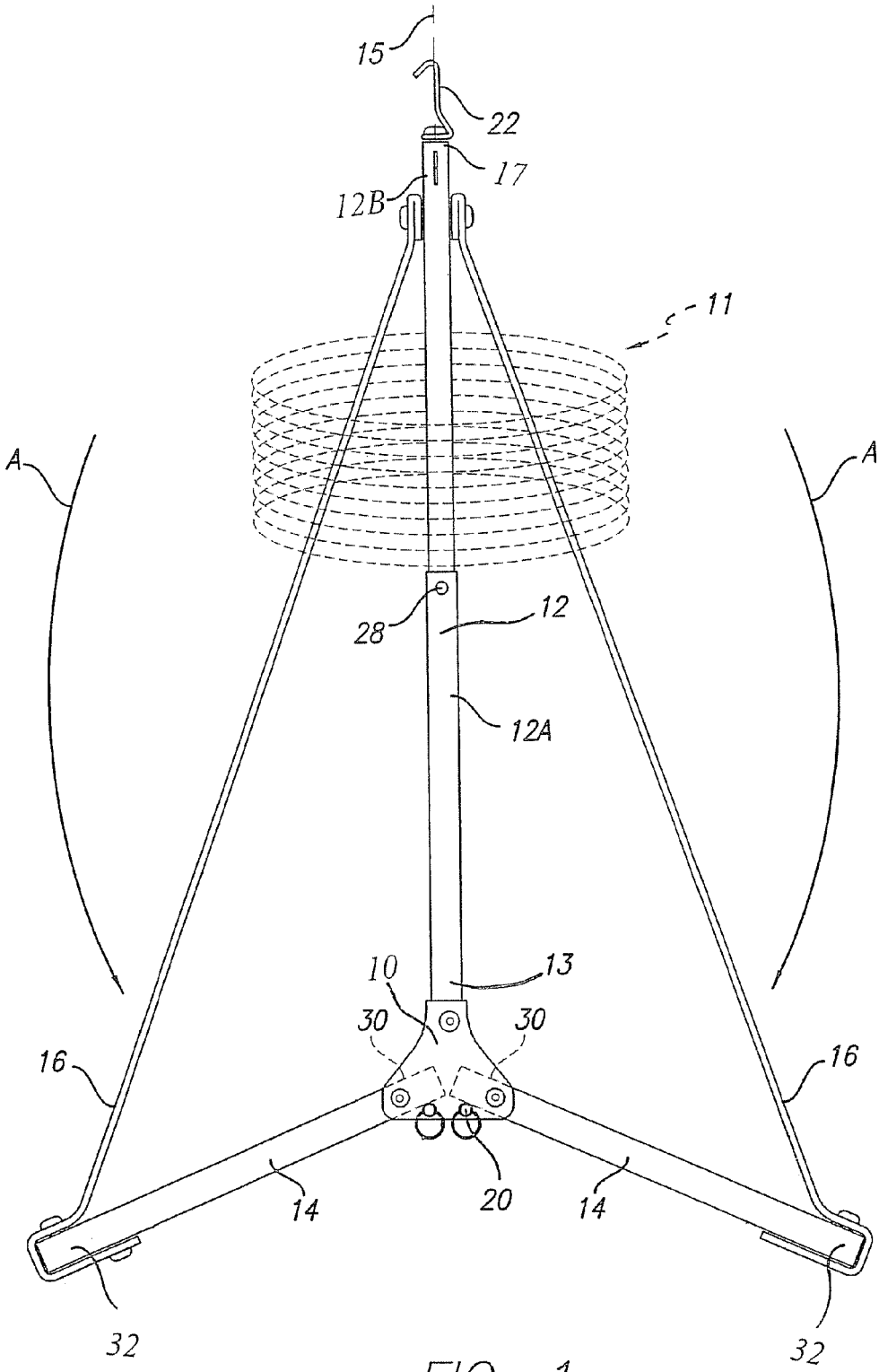
FIG. 1 is a side view of the collapsible wire reel in the extended position supporting a spool shown in phantom.

The present invention provides a wire reel that is operable between an extended position in which a spool is capable of being placed on the wire reel and dispensed and a collapsed position for storage and transport. As shown in FIG. 1, the wire reel comprises a base 10 with a stationary arm 12 and two supporting arms 14. In the preferred embodiment, cloth straps 16 connect each supporting arm 14 to stationary arm 12 as explained below and support a spool 11 that is being used to cable a building.

Figure 6:
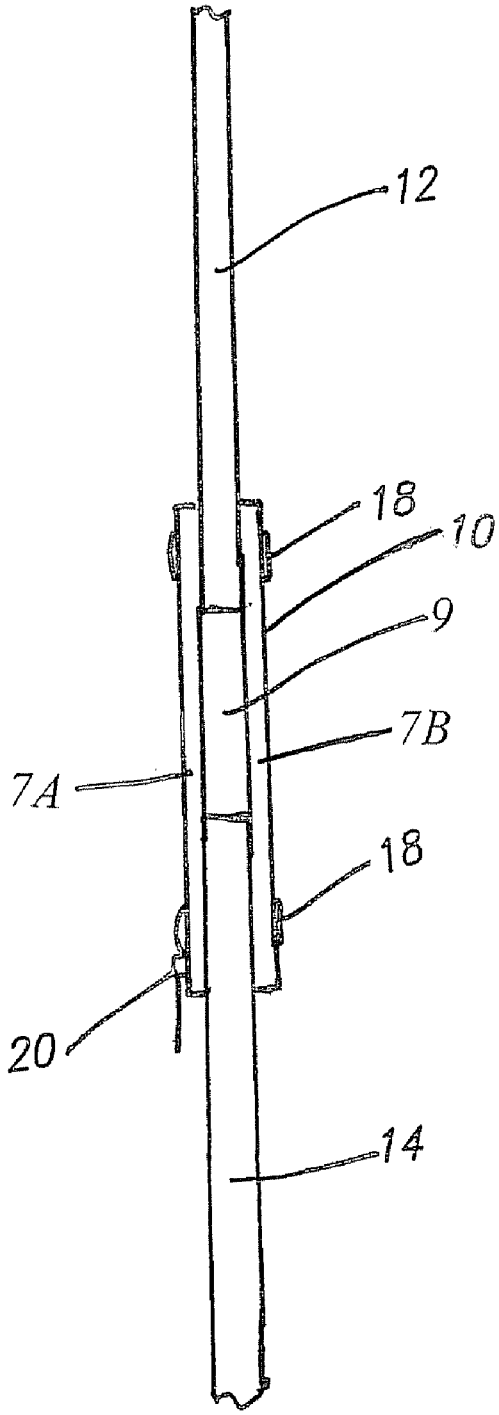
FIG. 6 is an end elevational view of the connection point between the arms of the collapsible wire reel at the base.

Base 10 can be any type of device which forms a central connection point for stationary arm 12 and supporting arms 14. In this preferred embodiment, base 10 comprises two symmetrical plates 7A, 7B, see FIG. 6, that are placed on both sides of stationary arm 12 and supporting arms 14 thereby defining a space 9 between the two plates 7A, 7B. Although two plates 7A, 7B are preferred, FIG. 1 shows the use of only a single plate 7A to better illustrate the connection between base 10, stationary arm 12 and supporting arms 14. A series of rivets 18 are used to secure base 10 to stationary arm 12 and supporting arms 14. In one embodiment shown in FIG. 3, base 10 defines two apertures which are capable of receiving a set of two pins 20 to lock the wire reel in the extended position as explained in greater detail below. In another embodiment depicted in FIG. 4, base 10 defines one aperture for one pin 20. If two plates 7A, 7B are used to construct base 10, the apertures should be defined by both plates and aligned in order to receive pin(s) 20.

Stationary arm 12 comprises a proximal end 13 that is attached to the top section of base 10 and a distal end 17 which further comprises a hook 22 to enable the wire reel to be easily suspended from a support structure such as a building's rafters, a utility poll, or a utility truck during the cabling process. Specifically, hook 22 is used to hang the wire reel on a nail or other device placed within a rafter, stud or other part of a building or vehicle. Additionally, hook 22 is preferably secured to stationary arm 12 in a manner that enables stationary arm 12 to rotate about a longitudinal axis 15 while hook 22 remains in a stationary position.

Figure 5:
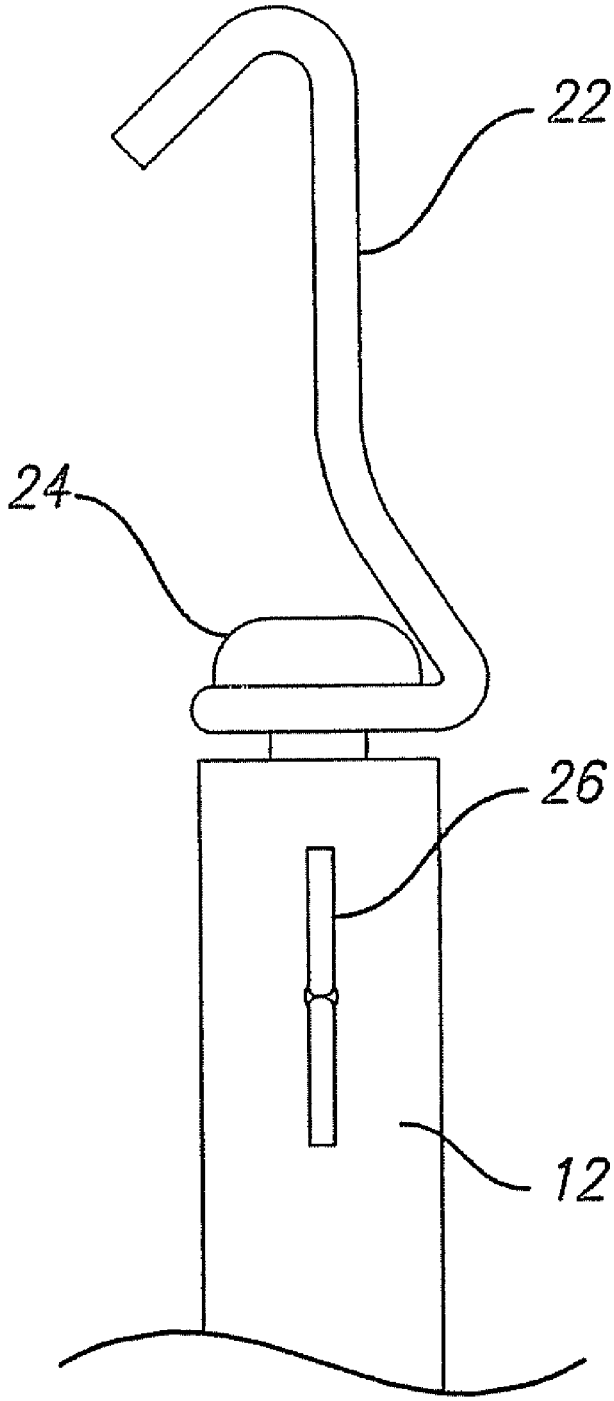
FIG. 5 is a close-up, side view of the top section of the stationary arm with a hook for suspending the collapsible wire reel from a support structure during use.

An example of a preferred method to connect hook 22 to stationary arm 12 to enable free rotation of stationary arm 12 (and therefore the entire wire reel) relative to hook 22 is shown in FIG. 5. In this preferred embodiment, stationary arm 12 is hollow and a clevis pin 24 is inserted within the top section of stationary arm 12 and secured to it by a cotter pin 26 which is passed though stationary arm 12 and clevis pin 24. Hook 22 is bent around clevis pin 24 and therefore is capable of remaining stationary while stationary arm 12 rotates.

Figure 2:
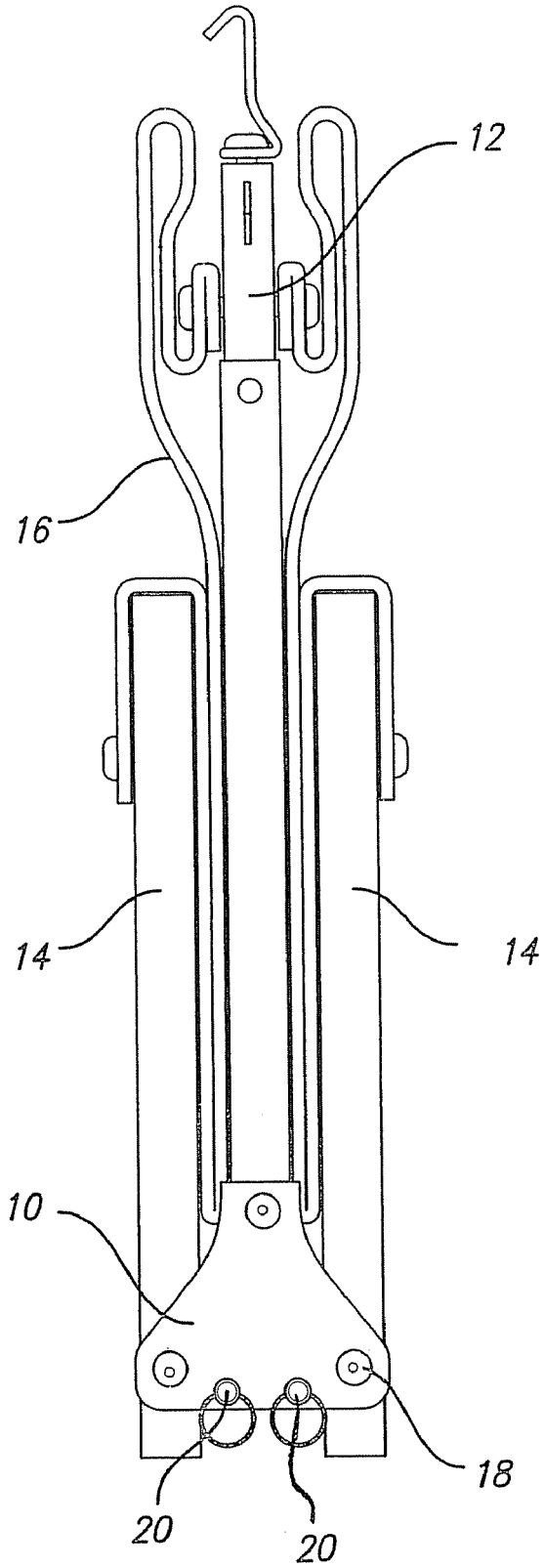
FIG. 2 is a side view of the collapsible wire reel in the collapsed position.

In this preferred embodiment, stationary arm 12 is extendable and is capable of being moved from an elongated state shown in FIG. 1 to a compact state shown in FIG. 2. As shown in FIG. 1, stationary arm 12 is extendable due to its construction from a lower tube 12A and an upper tube 12B. Lower tube 12A is hollow and preferably has a larger diameter than upper tube 12B. Upper tube 12B is able to slide in and out of lower tube 12A until the desired length of stationary arm 12 is reached. Alternatively, lower tube 12A could slide into upper tube 12B. To enable lower tube 12A to be locked into the desired location, an aperture 28 can be defined along lower tube 12A which can receive a spring-loaded peg located on upper tube 12B. As is known in the art, when upper tube 12B is slid to the point where the spring loaded peg meets aperture 28, the spring loaded peg slides out of aperture 28 and locks the lower and upper tubes 12A and 12B into place. In this preferred embodiment, stationary arm 12 is approximately twenty-four inches long in the elongated state and fifteen inches long in the compact state.

Each of the supporting arms 14 comprise a proximal end 30 which is connected to base 10 by additional rivets 18 and a free distal end 32 which swings outwardly from the base 10. In the preferred embodiment, supporting arms 14 are approximately thirteen inches long and rotate about an axis at base 10 from the extended position shown in FIG. 1 to the collapsed position depicted in FIG. 2.

In the preferred embodiment, straps 16 are secured to upper tube 12B by rivets 18 and are attached to the distal ends 32 of supporting arms 14 by rivets 18. Preferably, straps 16 are approximately thirty-two inches long and stretched over and around distal end 32 of each supporting arm 14 and secured to the opposing side of supporting arm 14 as shown in FIG. 1. Straps 16 can be fabric, ropes or cable in the preferred embodiment. Other materials can be used in alternative embodiments. Securing straps 16 to supporting arms 14 in this manner helps prevent straps 16 from slipping and becoming detached from either supporting arms 14 or stationary arm 12. In an alternative embodiment, adhesives, screws or other fasteners could be used in place of rivets 18 to secure straps 16 to supporting arms 14.

Figure 3:
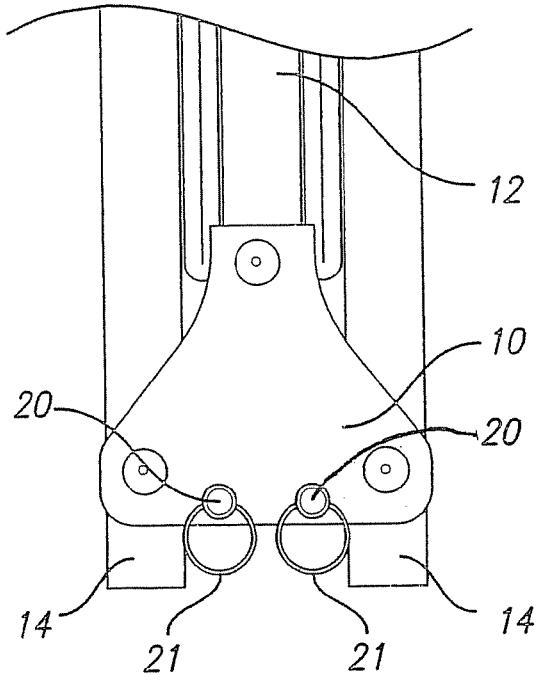
FIG. 3 is a side view of the base and supporting arms in one embodiment that uses two pins to retain the supporting arms in the extended position.
Figure 4:
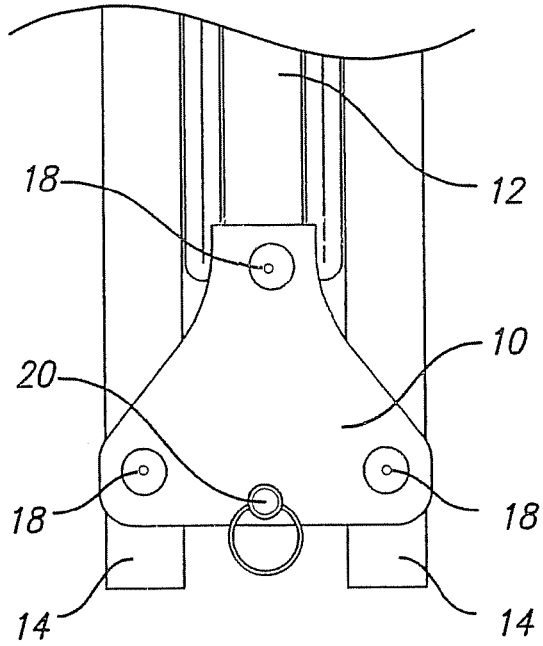
FIG. 4 is a side view of the base and supporting arms in another embodiment that uses one pin to retain the supporting arms in the collapsed position.

As noted above, the wire reel is kept in the extended position shown in FIG. 1 by one or two pins 20, preferably detent ring pins, inserted within apertures defined by base 10. FIG. 3 depicts the use of two pins 20 and FIG. 4 shows the use of only a single pin 20. In the preferred embodiment where detent ring pins are used, each pin 20 comprises a spring-mounted peg located on the side portion of pin 20 that is similar to the one used on stationary arm 12. Pin(s) 20 also include a ring 21 to assist the user in installing and removing them from base 10. Pin(s) 20 are properly installed when they have been passed through the apertures on both sides of base 10 so that the spring-mounted peg is on the opposing side of base 10 from ring 21.

After a user has rotated supporting arms 14 downward about the axis in the direction of arrows "A", he installs each supporting arm contacts pin(s) 20. In this preferred embodiment, the wire reel can be "locked" into the extended position by pulling upward on upper tube 12B until the spring-mounted peg on lower tube 12A engages aperture 28. At this point, supporting arms 14 are pointed downward and are at an angle greater than ninety degrees relative to stationary arm 12 and are in a non-parallel relationship with stationary arm 12. Spool 11 is placed on straps 16 and both the spool 11 and the wire reel spin freely about longitudinal axis 15 as wire is pulled from spool 11.

After the cabling job is complete, the user can push the spring loaded peg out of aperture 28 and remove pin(s) 20 from base 10 and fold supporting arms 14 upward towards stationary arm 12 placing the wire reel into the collapsed position shown in FIG. 2. Both supporting arms 14 are substantially parallel with stationary arm 12 enabling the wire reel to be easily stored and transported in the collapsed position. If desired, the user can reinstall pin(s) 20 which will assist in keeping supporting arms 14 in the collapsed condition because they will prevent the supporting arms 14 from complete expansion.

In an alternative embodiment, straps 16 can be eliminated and spool 11 can simply rest on supporting arms 14. In this embodiment, it is desirable to secure supporting arms 14 in the extended position with additional pins 20 inserted through apertures in body 10. Specifically, pins 20 should be placed above and below supporting arms 14 in base 10 after they have been rotated outward and extended to prevent them from collapsing during use. In this embodiment, four apertures would be defined by base 10, one above and below each supporting arm.

While the specific mention of certain specific types of pins has been made in this preferred embodiment, similar pins (such as cotter or hairpin pins) or other devices such as nails, screws, pegs, bolts, etc. can be used and still fall within the scope of the present invention. Additionally, similar fastening devices beside rivets 18 can be used to secure the various components to one another and fall within the scope of the present invention. Examples of such devices are screws, bolts, etc. Finally, while the use of only two supporting arms 14 has been discussed, additional supporting arms 14 could be used in the present invention.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A wire reel comprising:

a) a base defining at least one aperture with a removable pin;

b) a stationary arm connected to the base, said stationary arm having an upper end and a lower end;

c) a first supporting arm with a proximal end and a distal end wherein the first supporting arm is secured to the base at the proximal end and is capable of rotating about an axis at the proximal end and the first supporting arm is secured to the stationary arm by a strap connected to the distal end; and d) a second supporting arm with a proximal end and a distal end wherein the second supporting arm is secured to the base at the proximal end and is capable of rotating about an axis at the proximal end and the second supporting arm is secured to the stationary arm by a strap connected to the distal end;

the first and second supporting arms rotate about said axes during which the distal ends of said first and second supporting arms move downwardly until said first and second supporting arms contact the removable pin such that the first and second supporting arms are in the extended position, the first and second supporting arms are at an angle substantially greater than 90 degrees relative to the stationary arm when the first and second supporting arms are in the extended position to enable a wire to be easily pulled from the reel, said contact with said removable pin preventing downward movement of said first and second supporting arms relative to said stationary arm.

2. The wire reel according to claim 1 wherein the stationary arm is extendable.

3. The wire reel according to claim 1 further including a hook for connecting the wire reel to a support structure.

4. A wire reel comprising:

a) a base comprised of two plates that define a space between them;

b) an extendable stationary arm with a lower end mounted in said space, said lower end secured to the two plates, said extendable stationary arm having an upper end capable of being attached to a support structure;

c) a first supporting arm with a proximal end mounted in said space, said proximal end of said first supporting arm secured to the two plates, said first supporting arm having a distal end that is secured to the extendable stationary arm by a strap;

d) a second supporting arm with a proximal end mounted in said space, said proximal end of said second supporting arm secured to the two plates, said second supporting arm having a distal end that is secured to the extendable stationary arm by a strap; and e) the first and second supporting arms are moveable from an extended position in which a spool can be supported to a collapsed position for storage, the first and second supporting arms are each at an angle substantially greater than 90 degrees relative to the extendable stationary arm when the first and second supporting arms are in the extended position to enable a wire to be easily pulled from the reel, each said angle being measured between the upper end of said stationary arm and said first and second supporting arms.

5. The wire reel according to claim 4 wherein the two plates define aligned apertures capable of receiving a pin.

6. The wire reel according to claim 4 wherein the two plates define two aligned apertures, each of which is capable of receiving a pin.

7. The wire reel according to claim 4 further comprising a hook attached to the extendable stationary arm for attaching the wire reel to a support structure.

8. The wire reel according to claim 4 wherein the first and second supporting arms are substantially parallel with the extendable stationary arm when the first and second supporting arms are in the collapsed position.

9. A wire reel comprising:

a) a base defining at least one aperture;

b) an arm connected to the base;

c) two supporting arms, each of which has a proximal end connected to the base and a free distal end, the two supporting arms capable of moving from an extended position in which the supporting arms are at an angle substantially greater than 90 degrees relative to the arm connected to the base to enable a wire to be easily pulled from the reel to a collapsed position in which the supporting arms are substantially parallel with the arm connected to the base; and d) a pin inserted within each said aperture, said supporting arms contacting said pin in said extended position, the contact between the supporting arms and said pin preventing downward movement of said supporting arms relative to said base.

10. The wire reel according to claim 9 wherein the arm connected to the base is extendable.

11. The wire reel according to claim 9 further comprising a hook attached to the arm connected to the base for securing the wire reel to a support structure.

12. The wire reel according to claim 11 wherein the arm connected to the base rotates freely about the hook.

13. The wire reel according to claim 9 further including two straps that each extend from the arm connected to the base to the free distal end of each supporting arm.

14. A wire reel comprising:

a) a base;

b) an arm connected to said base, said arm having an upper end and a lower end;

c) a first supporting arm with a proximal end and a distal end wherein the first supporting arm is secured to the base at the proximal end and is capable of rotating about an axis at the proximal end and the first supporting arm is secured to the arm connected to the base by a strap connected to the distal end, the first supporting arm capable of being moved to an extended position in which the first supporting arm is at an angle which is measured between the upper end of the arm connected to the base and said first supporting arm which is substantially greater than 90 degrees to enable a wire to be easily pulled from the reel; and d) a second supporting arm with a proximal end and a distal end wherein the second supporting arm is secured to the base at the proximal end and is capable of rotating about an axis at the proximal end and the second supporting arm is secured to the arm connected to the base by a strap connected to the distal end, the second supporting arm capable of being moved to an extended position in which the second supporting arm is at an angle which is measured between the upper end of the arm connected to the base and said second supporting arm which is substantially greater than 90 degrees to enable a wire to be easily pulled from the reel.

15. The wire reel according to claim 14 wherein the arm connected to the base is extendable.

16. The wire reel according to claim 14 wherein the base defines at least one aperture with a removable pin.

17. The wire reel according to claim 16 wherein the first and second supporting arms rotate about said axes until they contact the removable pin such that the first and second supporting arms are in the extended position.

18. The wire reel according to claim 14 further including a hook for connecting the wire reel to a support structure.

* * * * *